United States Patent [19]

Brune

[11] Patent Number: 4,510,500

[45] Date of Patent: Apr. 9, 1985

[54] AIRCRAFT SHORTED LOOP ANTENNA WITH IMPEDANCE MATCHING AND AMPLIFICATION AT FEED POINT

[75] Inventor: John F. Brune, Tinton Falls, N.J.

[73] Assignee: The United States of America as represented by the Secretary of the Army, Washington, D.C.

[21] Appl. No.: 461,766

[22] Filed: Jan. 28, 1983

[51] Int. Cl.[3] ..... H01Q 1/28

[52] U.S. Cl. ..... 343/708; 343/845; 343/861; 455/193

[58] Field of Search ..... 343/701, 745, 747, 748, 343/845; 455/193, 269, 276

[56] References Cited

U.S. PATENT DOCUMENTS

| | | | |
|---|---|---|---|
| 2,913,722 | 11/1959 | Brueckmann | 343/861 |
| 3,818,480 | 6/1974 | West | 343/861 |
| 4,186,350 | 1/1980 | Takayama | 455/193 |
| 4,339,827 | 7/1982 | Torres et al. | 343/748 |
| 4,343,001 | 8/1982 | Anderson et al. | 343/845 |
| 4,403,347 | 9/1983 | Iso et al. | 455/193 |

OTHER PUBLICATIONS

IEEE Transactions on Antennas and Propagation, vol. AP-23, No. 4, Jul., 1975, pp. 462-469, "Small Antennas", H. Wheeler.

Instruction Book of Bayshore Systems Corporation, entitled, "UPS-192A Active Antenna System", Feb., 1978, pp. 3-4.

Manufacturer's spec. sheet entitled, "Active Receiving Antennas A 1205 Active DF Antennas AK 1205"-Telefunken.

*Electronics World*, Mar., 1968, pp. 49-52, "Tiny Antennas Push State-of-Art", Paul E. Mayes.

*Primary Examiner*—E. Lieberman

*Attorney, Agent, or Firm*—Anthony T. Lane; Jeremiah G. Murray; Robert A. Maikis

[57] ABSTRACT

An active antenna system for an airborne high frequency single sideband receiver comprised of a shorted loop type antenna having an inductive characteristic over the frequency range of 2.0 to 10.0 MHz and which is tuned to resonance at a selected operating frequency by shunting the antenna at its feedpoint by selectively switched sets of voltage variable capacitors. Also coupled to the feedpoint is a field effect transistor which is adapted to provide radio frequency amplification. Impedance matching between the output of the field effect transistor and the input of a radio frequency receiver is further provided by a transistor configured as an emitter follower.

15 Claims, 2 Drawing Figures

AIRCRAFT SHORTED LOOP ANTENNA WITH IMPEDANCE MATCHING AND AMPLIFICATION AT FEED POINT

The invention described herein may be manufactured and used by or for the Government for governmental purposes without the payment of any royalties thereon or therefor.

FIELD OF THE INVENTION

This invention relates generally to antennas for radio frequency communications and more particularly to an active antenna system therefor.

BACKGROUND OF THE INVENTION

Electrically short antennas are well known in the art and comprise an antenna whose size is a small fraction of the wavelength with which it operates. Such antennas exhibit either an inductive or capacitive characteristic and are tuned to resonance by a reactance of the mutually opposite type. Its bandwidth of impedance matching, moreover, is subject to a fundamental limitation measured by its radiation and power factor which is proportional to its effective volume. These principles are reviewed and expanded together with a consideration of active antennas in an article entitled, "Small Antennas", by Harold A. Wheeler, which appeared in the *IEEE Transactions On Antennas and Propagation,* Vol. AP-23, No. 4, July, 1975, pp. 462–469.

In an airborne high frequency single sideband communication system where a resonant length antenna cannot be utilized due to aircraft size restraints, prior art practice typically involves the use of mechanically adjusted passive reactances together with RF amplification at a point remote from the antenna feedpoint.

SUMMARY

Accordingly, it is an object of the present invention to provide an improvement in high frequency antenna systems.

It is another object of the present invention to provide an improvement in active high frequency antenna systems.

It is yet another object of the present invention to provide an improvement in antenna systems which are intended for use only in the receive mode.

It is still yet another object of the present invention to provide an improvement in an active receiving antenna system which provides electronic tuning as well as radio frequency amplification and impedance matching directly at the antenna feedpoint.

Briefly, these and other objects are accomplished by means of a shorted loop type of antenna operable in the HF frequency band with the antenna being tuned directly at the feedpoint by a set of selectively connected voltage variable capacitors. RF amplification means in the form of a field effect transistor is furthermore coupled to the feedpoint to provide an increase in the signal level of a received RF signal in the 2–10 MHz portion of the HF frequency band. The output of the RF amplifier means is coupled to the input of radio receiver means by an impedance matching device in the form of a transistor connected in an emitter follower circuit configuration.

DESCRIPTION OF THE PREFERRED EMBODIMENT

Figure 1:
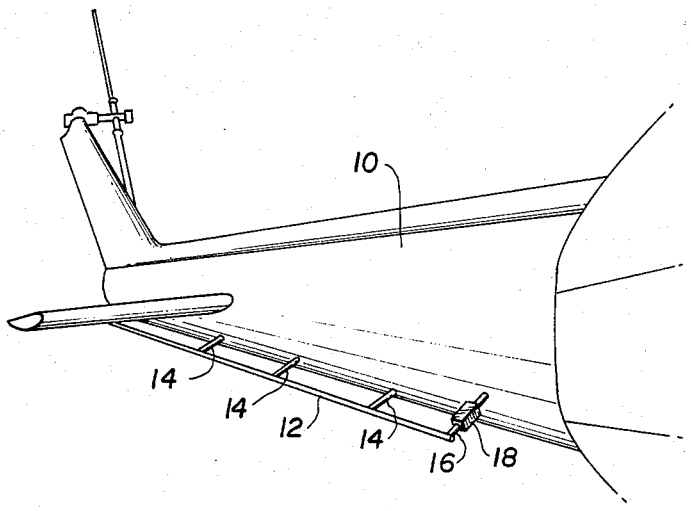
FIG. 1 is a perspective view of an aircraft with an antenna, in accordance with the subject invention, mounted thereon.

Referring now to the drawings and more particularly to FIG. 1, reference numeral 10 designates the skin of the rear portion of an aircraft, for example a helicopter, on which is mounted a shorted loop type antenna 12 comprising a 14 ft. 9 in. long aluminum tube supported 8 in. from the aircraft skin by means of three standoff type insulators 14. The antenna 12 is utilized for radio communications at the low end of the HF frequency band (2–10 MHz). The antenna 12, moreover, includes a feedpoint 16 which comprises the near end of the aluminum tube shown in FIG. 1. The antenna 12 in this invention is intended to be used in the receive mode only, but is not limited to such use, and is coupled to receiver apparatus, such as a single sideband receiver, not shown, within the aircraft and furthermore is coupled thereto by means of a tuning and amplification unit 18 which is located outside of the aircraft immediately adjacent the feedpoint 16. The antenna 12 has a predominantly inductive characteristic over the 2–10 MHz frequency range and accordingly can be tuned to resonance at a selected frequency by shunting the antenna with an appropriate capacitance coupled to the feedpoint 16.

Figure 2:
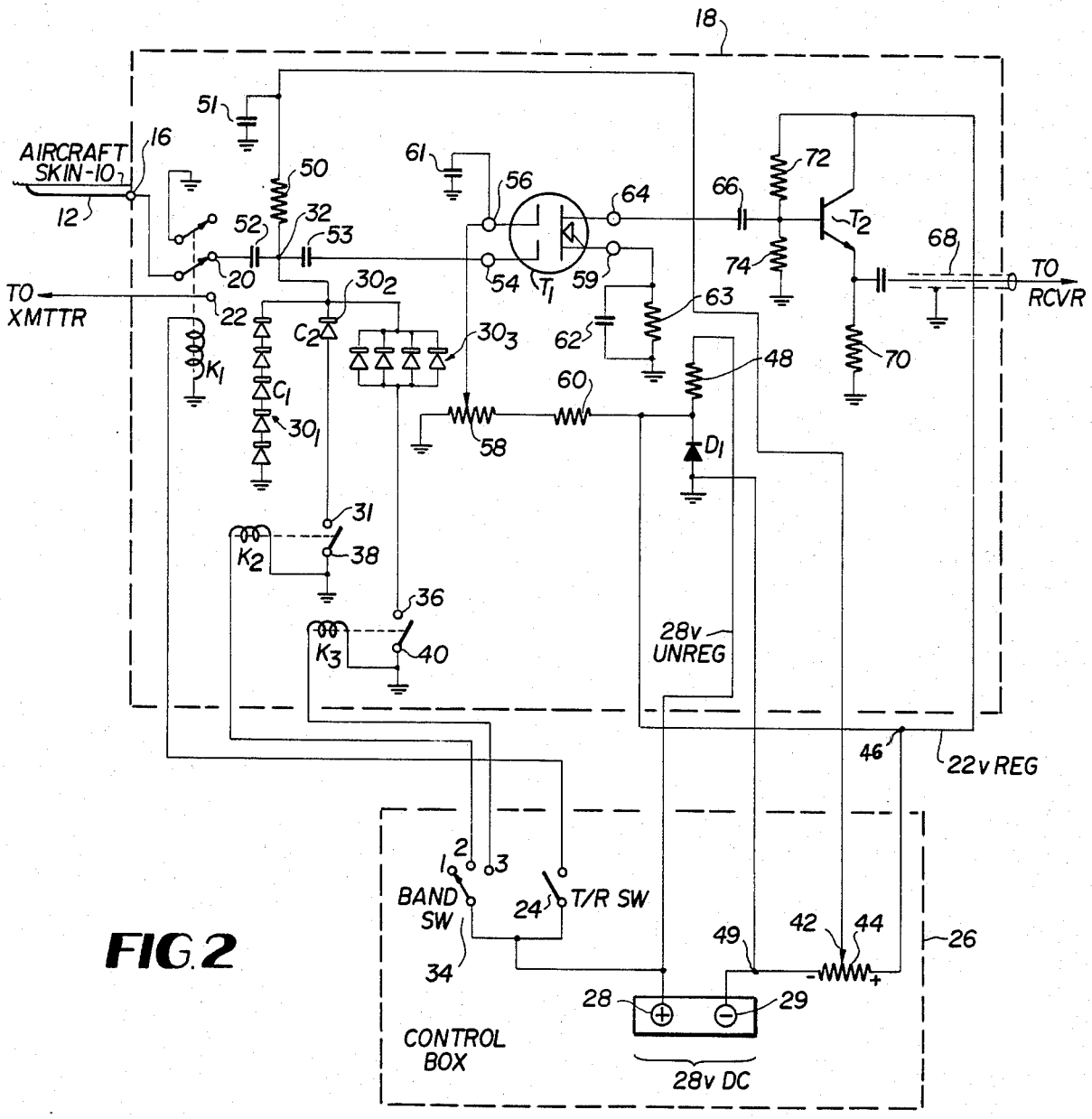
FIG. 2 is an electrical schematic diagram of the preferred embodiment of an active receiving antenna system in accordance with the subject invention.

Referring now to FIG. 2, the unit 18 is shown schematically including a change-over relay $K_1$ for switching the antenna feedpoint 16 between relay terminals 20 and 22 which are respectively coupled to active tuning and amplification circuitry, to be described during a "receive" mode and to passive tuning coupler, not shown, during a "transmit" mode. Since the antenna 12 is to be used in the receive mode only, a transmit-receive (T/R) switch 24 in a control box 26 remotely located from antenna 12, such as being located within the aircraft, is adapted to be operated along with a manually operated push-to-talk (PTT) switch, not shown, to assure automatic change over from any keying position on the part of an operator in the aircraft. Accordingly, when the switch 24 is in the open position which corresponds to the receive mode, the feedpoint 16 is connected to relay terminal 20. In the transmit mode, the switch 24 is closed and the positive (+) terminal 28 of a 28 vdc supply potential coupled across terminals 28 and 29 in the control box 26 is applied to the coil of relay $K_1$ which is activated thereby causing the feedpoint 16 to be connected to terminal 22. As shown, the opposite side of $K_1$ relay coil is coupled to ground as is the negative (−) terminal 29. Additionally, activation of the relay $K_1$ connects relay terminal 20 to ground, which operates to protect the remainder of the circuit components in the unit 18 during the transmit mode.

The antenna 12 is adapted to be capacitively tuned in three discrete steps over the frequency band of 2.0 to 10 MHz by means of three sets of voltage variable capacitors $C_1$, $C_2$ and $C_3$ comprised, for example, of one or more MSI-125 varicaps 30, devices well known to those skilled in the art. As shown in FIG. 1, the capacitance $C_1$ is comprised of five such varicaps $30_1$ coupled in series between circuit junction 32 and ground while the capacitance $C_2$ is comprised of a single varicap $30_2$ coupled between circuit junction 32 and relay terminal 31 of a relay $K_2$. Relay $K_2$ is adapted to be activated by the +28 vdc potential applied across its relay coil through the second position of a three position frequency band switch 34. The third capacitance $C_3$ is comprised of four varicaps $30_3$ connected in parallel between circuit junction 26 and relay terminal 36 of relay $K_3$ which is adapted to be energized by the +28 vdc terminal 28 connected thereto through the third position of the band switch 34.

It can be seen that in the first position of the band switch 34, only the series connected varicaps $30_1$ forming the capacitance $C_1$ is connected between circuit junction 32 and ground. In the second position, however, the capacitances $C_1$ and $C_2$ are connected in parallel to ground due to the fact that relay terminal 38 of relay $K_2$ is connected to ground. In the third position of the band switch 34, the capacitance $C_1$ and the four parallely connected varicaps $30_3$ forming the capacitance $C_3$ are connected in parallel due to the fact that relay terminal 40 of $K_3$ is connected to ground.

As is well known, a series connection of capacitors provides a composite capacitance which is less than the capacitance of the capacitor having the largest value whereas a set of parallel connected capacitors comprises a composite capacitance which is the sum of the individual capacitances. In the circuitry of FIG. 2, the capacitance of the individual varicaps 30 is controlled by means of a variable DC voltage applied to circuit junction 32 from the slider element 42 of a potentiometer 44 located in the control box 26 and connected across a source of regulated 22 vdc voltage provided by a voltage regulator diode $D_1$ located in the unit 18. The diode $D_1$ is connected across the 28 vdc supply terminals 28 and 29 in the control box 26 by means of resistor 48. As shown, the positive side of the potentiometer 44 is connected to circuit junction 46 while the negative side is connected to circuit junction 49 which is common to the negative (−) supply terminal 29 and ground.

The variable voltage applied to the varicaps 30 making up the capacitances $C_1$, $C_2$ and $C_3$ is applied to circuit junction 32 through an RF decoupling network consisting of a series resistor 50 and a capacitor to ground 51. Accordingly, the antenna 12 can be tuned, for example, by the capacitance $C_1$ in a first band (Band 1) between the frequencies of 7.0 and 8.5 MHz, in a second band (Band 2) between the frequencies 5.0 and 7.2 MHz by the parallel combination of $C_1$ and $C_2$, and in a third band (Band 3) between the frequencies 2.5 and 5.1 MHz by the parallel combination of $C_1$ and $C_3$.

In addition to the active antenna tuning elements, the unit 18 includes an RF amplifying device $T_1$ which comprises a field effect transistor (FET), typically a 3N140, which comprises a dual gate device. The gate identified by terminal 54 comprises the signal input and is coupled to the antenna feedpoint 16 by means of $K_1$ relay terminal 20 and two series connected capacitors 52 and 53 which have a common connection at junction 32. The second gate terminal 56 is used to adjust the gain of the FET amplifier $T_1$ by the application thereto of a second variable DC potential derived from the 22 volt regulator diode $D_1$ by means of a potentiometer 58 and a series connected resistor 60. Additionally, a capacitor 61 is connected from the gate terminal 56 to ground to provide an RF bypass. Terminal 59 comprises the source terminal and is biased by the combination of resistor 63 and capacitor 62 connected in parallel to ground. The drain terminal 64 comprises the output terminal of the RF amplifier and is coupled to the base of an output transistor $T_2$ by means of a coupling capacitor 66.

The transistor $T_2$ typically comprises a 2N2222 NPN transistor which is connected in an emitter follower configuration in order to match the relatively high output impedance of RF amplifier $T_1$ (300 ohms) to a value (50 ohms) to match the impedance of a coaxial cable 68 and the input of the HF receiver, not shown, inside the aircraft (FIG. 1). The emitter follower circuit configuration includes the direct connection of the regulated +22 vdc provided by the diode $D_1$ to the collector of transistor $T_2$ while its emitter, across which the output is taken, is coupled to ground through the resistor 70. Proper base biasing of the transistor $T_2$ is provided by the voltage divider action of the series connected resistors 72 and 74.

In summation, the impedance of the shorted loop antenna 12 as installed on the outer surface 10 of the aircraft is that of a nearly pure inductor. In the receive mode, relay $K_1$ is deenergized and the change-over relay contact 20 connects the feedpoint 16 of the shorted loop antenna 12 to the selected varicap grouping. The appropriate value of capacitance is provided by the selected combination of $C_1$, $C_2$ and $C_3$ to produce parallel resonance at a given frequency thus providing a pure resistance of a high order of value. A received signal imposed on this high order of resistance is coupled to the input of the FET amplifier $T_1$ which provides a gain of considerable magnitude, for example, 40 db at a translation of impedance level to approximately 300 ohms. This impedance level is then transformed back down to 50 ohms by the emitter follower $T_2$ and connected to the receiver, for example, by a BNC 50 ohm coaxial connector, not shown, and a length of coaxial cable.

Thus what has been shown and described is a means for tuning an electrically short antenna by use of voltage variable capacitors, and connecting an active amplifying element directly to feedpoint of the antenna. The antenna element thus becomes the inductive portion of a parallel tuned circuit which provides increased efficiency and precise tuning while the placement of the active amplifier at the feedpoint contributes to an increase in the signal to noise ratio.

While the foregoing detailed description has been made with a certain degree of particularity, it should be noted that the same has been made by way of illustration and not of limitation. Accordingly, all modifications, alterations and changes coming within the spirit and scope of the invention as set forth in the appended claims are herein meant to be included.

I claim:

1. An active antenna system coupled to remotely located radio apparatus comprising:

an electrically short antenna element having an inductive electrical characteristic mounted on a ground plane and including a feedpoint;

capacitance means, variable in accordance with the application of an electrical voltage signal thereto, coupled to said feedpoint for electronically tuning the antenna element to resonance at a selected operating frequency, said voltage variable capacitance means comprising sets of voltage variable capacitors selectively connected together in parallel with said antenna element to provide different values of composite capacitance for tuning the antenna element and being physically located in close proximity to said feedpoint;

means for controlling the amplitude of the electrical voltage signal applied to said capacitance means, said voltage controlling means being remotely located from said feedpoint; and RF amplifier means coupled between said feedpoint and said radio apparatus for amplifying high frequency electrical signals derived from said antenna element, said RF amplifier means being physically located in close proximity to said feedpoint.

2. An active antenna system coupled to radio apparatus comprising:

an electrically short antenna element having an inductive electrical characteristic mounted on a ground plane and including a feedpoint;

capacitance means, variable in accordance with the application of an electrical voltage signal thereto, coupled to said feedpoint for electronically tuning the antenna element to resonance at a selected operating frequency, said voltage variable capacitance means comprising three sets of voltage variable capacitors selectively connected together to provide different values of composite capacitance for tuning the antenna element;

means for controlling the amplitude of the electrical voltage signal applied to said capacitance means; and RF amplifier means coupled between said feedpoint and said radio apparatus for amplifying high frequency electrical signals derived from said antenna element.

3. The active antenna system as defined by claim 2 wherein a first of said three sets of voltage variable capacitors comprise a plurality of voltage variable capacitors respectively connected together in series, wherein a second of said three sets of voltage variable capacitors comprises a plurality of voltage variable capacitors respectively connected in parallel with one another, wherein a third of said three sets of voltage variable capacitors comprises a single voltage variable capacitor.

4. The active antenna system as defined by claim 3 wherein said second and third sets of voltage variable capacitors are selectively coupled in parallel with said first set of voltage variable capacitors or uncoupled therefrom.

5. An active antenna system coupled to radio apparatus comprising:

an electrically short antenna element having an inductive electrical characteristic mounted on a ground plane and including a feedpoint, said antenna element comprising a shorted loop type of antenna operable in the high frequency band of the electromagnetic spectrum;

capacitance means, variable in accordance with the application of an electrical voltage signal thereto, coupled to said feedpoint for electronically tuning the antenna element to resonance at a selected operating frequency, said voltage variable capacitance means comprising a plurality of voltage variable capacitors selectively connected together to provide different values of composite capacitance for tuning the antenna element;

means for controlling the amplitude of the electrical voltage signal applied to said capacitance means; and RF amplifier means coupled between said feedpoint and said radio apparatus for amplifying high frequency electrical signals derived from said antenna element.

6. The active antenna system as defined by claim 5 wherein said shorted loop type of antenna is adapted to operate in the region between 2 and 10 MHz.

7. The active antenna system as defined by claim 6 wherein said ground plane comprises the body of an aircraft.

8. The active antenna system as defined by claim 7 wherein said radio apparatus comprises radio receiver apparatus, and additionally including means for alternately switching the feedpoint of said antenna element to and from the input of said radio receiver apparatus in a receive mode and a transmit mode, respectively.

9. The active antenna system as defined by claim 8 wherein said means for switching is operable to connect the input of said RF amplifier means to a point of zero reference in said transmit mode.

10. The active antenna system as defined by claim 8 wherein said RF amplifier means comprises transistor circuit means comprised of a pair of current conducting terminals defining a conductive region controlled by a third terminal, and wherein said control terminal is coupled to said feedpoint in said receive mode and having one of its pair of power conducting terminals coupled to said input of said radio receiver apparatus.

11. The active antenna system as defined by claim 10 and additionally including impedance matching means coupled between said one terminal of said transistor circuit means and said radio receiver apparatus.

12. The active antenna system as defined by claim 11 wherein said transistor circuit means comprises a field effect transistor.

13. The active antenna system as defined by claim 11 wherein said impedance matching means comprises another transistor circuit means coupled to said first recited transistor circuit means.

14. The active antenna system as defined by claim 13 wherein said another transistor circuit means comprises an emitter follower circuit configuration.

15. The active antenna system as defined by claim 8 wherein said feedpoint switching means comprises a relay activated in accordance with the operation of manually operated switch means located at a point remote from said feedpoint.

* * * * *